350-1.7 SR
8/12/86 XR 4,605,232

United States Patent [19]
Hundstad

[11] Patent Number: 4,605,232
[45] Date of Patent: Aug. 12, 1986

[54] INFRARED RADIATION RESPONSIVE TARGET

[76] Inventor: Richard L. Hundstad, 221 Woodside Rd., Pittsburgh, Pa. 15221

[21] Appl. No.: 603,350

[22] Filed: Apr. 24, 1984

[51] Int. Cl.[4] ..... F41J 1/00

[52] U.S. Cl. ..... 273/348.1; 428/319.1; 428/325; 428/331; 428/461; 350/106; 350/1.7; 72/207; 237/79

[58] Field of Search ..... 273/348.1; 350/105, 350/106, 109, 1.1, 1.6, 1.7; 126/141, 345; 219/213, 461, 347, 405, 538; 378/256; 250/255, 256, 257; 428/319.1, 308.4, 331, 325, 343, 461; 404/14; 237/79; 72/184, 191, 207

[56] References Cited

U.S. PATENT DOCUMENTS 543,607 7/1895 Bates ..... 72/207 X
1,810,168 6/1931 Gray ..... 404/14 X
1,966,318 7/1934 Stephens ..... 404/14 X
2,060,088 11/1936 Lane ..... 237/79
2,354,018 7/1944 Heltzer et al. ..... 350/105
2,407,680 9/1946 Palmquist et al. ..... 350/105
3,437,536 4/1969 Vincent et al. ..... 428/319.1 X
3,599,465 8/1971 Chenevier ..... 72/207
4,066,261 1/1978 Stewart ..... 273/403
4,191,451 3/1980 Hodges ..... 350/105 X
4,239,236 12/1980 Parham et al. ..... 273/403
4,279,599 7/1981 Marshall et al. ..... 273/348.1
4,514,998 5/1985 Jury ..... 72/207 X

*Primary Examiner*—Paul E. Shapiro

[57] ABSTRACT

Novel techniques for scattering infrared radiation are employed to form a diffuse retro-reflector suitable as a target for night viewing by an infrared responsive detector.

12 Claims, 8 Drawing Figures

INFRARED RADIATION RESPONSIVE TARGET

BACKGROUND OF THE INVENTION

The military has made extensive use of various simulated targets and target materials in conjunction with its training personnel and the qualifications of various weapon and detection systems. While daylight targets are relatively simple and readily available, simulated target systems proposed for night use are more complex and costly and have not proven to be totally reliable and acceptable. Typically the visibility and distinguishability of targets at night results from their infrared (IR) radiation and the specific pattern of radiation (signature) which these targets emit due to their characteristic temperature distribution. This IR radiation pattern can be remotely detected by appropriate IR sensitive optical devices associated with weapon systems. At the ambient temperatures involved small variations in absolute temperature produce relatively large variations in the flux density of IR radiation. As a result of these considerations, an attempt is made to have the specific pattern of heating of a practice target fashioned so as to simulate the IR radiating flux density distribution (target signature) which would be observed from an actual target. This approach has not proven completely satisfactory for various reasons including the fact that the temperature of the practice target is sensitive to prevailing weather conditions, e.g., wind.

SUMMARY OF THE INVENTION

The innovative, inexpensive infrared radiation responsive retro-reflective practice target disclosed herein with reference to the accompanying drawing is based on the application of an infrared reflective target coating or cover to a portion of a target object identified as a target surface such that the target surface will reradiate, or reflect, in a diffuse fashion in response to impinging infrared radiation from a remote source. The generic concept of this invention involves a target material which can be applied to a surface of an object so that when the target material is subjected to a primary source of IR radiation it will efficiently retro-reflect the primary IR radiation in a diffuse or semi-diffuse fashion, thereby, simulating the IR radiation from a thermally heated target surface. The primary source of IR radiation has no stringent requirements and could be diffuse, columnar, or even coherent with little effect on the simulated thermal radiation.

The most significant element is the retroreflective target composition which transforms the primary IR radiation into a diffuse retro-reflection simulating thermal radiation. The target composition produces scattering of the primary IR radiation such that the retro-reflected IR radiation exhibits a diffuse or semidiffuse distribution of radiant flux.

Several techniques for producing a diffuse retro-reflection have been experimentally evaluated and verified. As has been previously discussed, the implementation of the invention produces a target which accomplishes the desired optical scattering of the incident IR radiation and results in a diffuse retro-reflection. Techniques for accomplishing diffuse retro-reflection can be classified as follows:

1. Reflection from well defined threedimensional contoured surfaces highly reflective to IR radiation;

2. Reflection from randomly oriented reflective s faces;
3. Reflection provided by multiple refractions and flections both from and through IR transmitting terials;
4. Reflection from small reflective particles, or bubb suspended in a material capable of transmitting radiation; and
5. Combinations of the above.

DESCRIPTION OF THE DRAWINGS

The invention will become more readily appa from the following exemplary description in connec with the accompanying drawings.

DESCRIPTION OF THE PREFERRED EMBODIMENT

Figure 1:
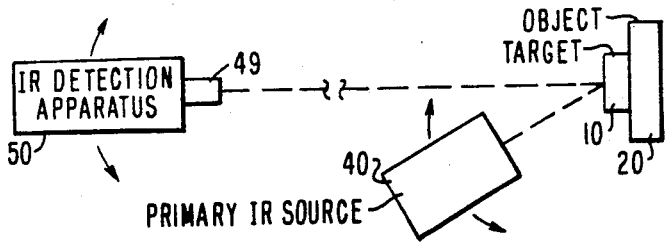
FIG. 1 is a schematic illustration of a target sys including the novel target affixed to a target object spaced apart from a primary source of infrared radia energy and an infrared radiation detection system.

Referring to FIG. 1 there is schematically illustr an infrared radiation (IR) responsive retroreflec practice target 10 attached to an object 20 which typically be a plywood model representation of a tary vehicle. The target 10 reflects impinging infr radiation directed onto it from a primary infrared ra tion energy source 40. The reflected infrared radia energy from the target 10 is monitored by an infr radiation sensitive optical device 49, e.g. scope, ass ated with an infrared radiation detection apparatus The target detection information provided by the a ratus 50 may be processed locally or remotely.

The source, which is typically positioned at a tance of several meters from the target 10, may be ported from the object 20 in the event the object 20 representation of a moving vehicle. The detection a ratus 50 may be located at distances of up to sev thousand meters from the target 10 depending on target range and scale of the target.

The orientation of the source 40 and the detection apparatus 50 may be other than that illustrated in FIG. 1.

The target 10 includes an infrared energy responsive diffuse retro-reflective material which can be configured to correspond to a predetermined portion of the object 20. The target 10 exhibits a surface pattern of contours, particles or bubbles which are sufficiently small that the individual patterns of reflected IR are not discernible by the detector 49. This is accomplished by assuring that the spacing of the elements of the reflector pattern are smaller than the resolution of the IR sensitive optical device 49. The particle or bubble target material is typically affixed to a polished metal, such as aluminum or copper, which exhibits the desired specular reflective characteristics.

Figure 2A:
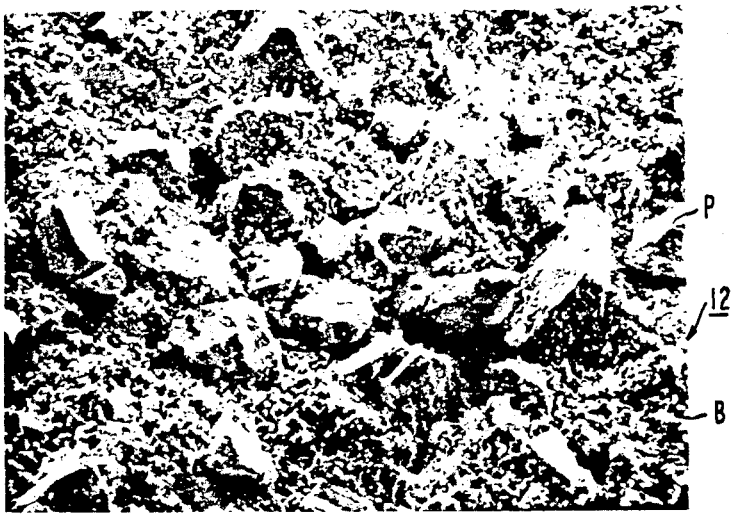
FIG. 2A is an SEM (Scanning Electron Microsc photograph of the surface of a retro-reflective ta material comprising IR transmissive particles at a m nification of approximately 100×, with a high inde refraction suspended in an IR transmissive binder.
Figure 2B:
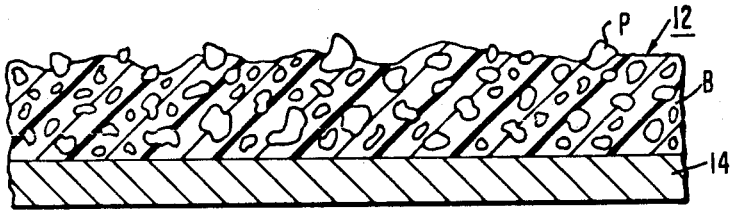
FIG. 2B is a sectioned schematic illustration of target embodiment of FIG. 2A applied as a coating reflective metal surface such as a metallic alumi tape.

Referring to FIGS. 2A and 2B the target 10 is illustrated as a conformable coating 12 consisting of finely divided particles P of a material composition which exhibits a relatively low asorption of infrared radiation and a relatively high index of refraction suspended within a binder B exhibiting a relatively low absorption of infrared radiation energy. The combination of the particles P and the binder B may be mixed to form a slurry which is then applied to a reflective target support or substrate. In the alternative the target coating 12 may be applied directly to the target portion of the object 20.

The particles P provide the desired diffuse reflection of the incident infrared radiation. Initial scattering results from random reflection (scattering) from the surfaces of randomly oriented the particles P. In the case of silicon particles approximately 35% of incident IR radiation is reflected from exposed front surfaces of the particles P. the binder B, as well as the particles P, exhibit a low absorption of infrared radiation wherein absorption corresponds to a loss mechanism which reduces the reflection efficiency. The high index of refraction of the selected IR transmitting particles P also aids in providing additional scattering of the impinging infrared radiation so as to minimize the thickness of tha particle-binder coating 12 that is required to achieve efficient and uniform diffuse retro-reflection of the infrared radiation energy emitted by the primary source 40.

While in theory almost any infrared transmissive material may be considered suitable for the particles P, including common table salt (NaC1), materials with a relatively high index of refraction such as silicon, germanium, and zinc selenide are particularly advantageous because the desired scattering due to refraction can be accomplished with a lesser number of traverses through the individual refractive particles. Thus, with highly refractive particles, the desired scattering is accomplished with a relatively thin coating 12 forming the target 10 thereby reducing infrared energy absorption and increasing the target retro-reflection efficiency. Commercially available binders which have proven to be particularly beneficial as a binder for the novel target composition include commercially available products such as polyethylene, silicon varnish type materials and poly(isobutylene) materials. The index of refraction of the binder should be low relative to the particles in order to enhance scattering due to differences in refractive index.

A practical embodiment of the target concept of FIG. 2A is illustrated in FIG. 2B wherein the particlebinder coating 23 is applied to the polished metallic surface of a metallic support member 14 which may be a metal tape, or decal, having adhesive backing which permits easy attachment to the object 20.

While the suspension of the particles P in a suitable binder B to produce a diffuse reflector target coating or paint represents one implementation of this target concept, the application of a target coating to an object can be accomplished by initially coating a target surface or object with the binder B and then randomly distributing particles P onto the binder B prior to the curing of the binder B.

Figure 3:
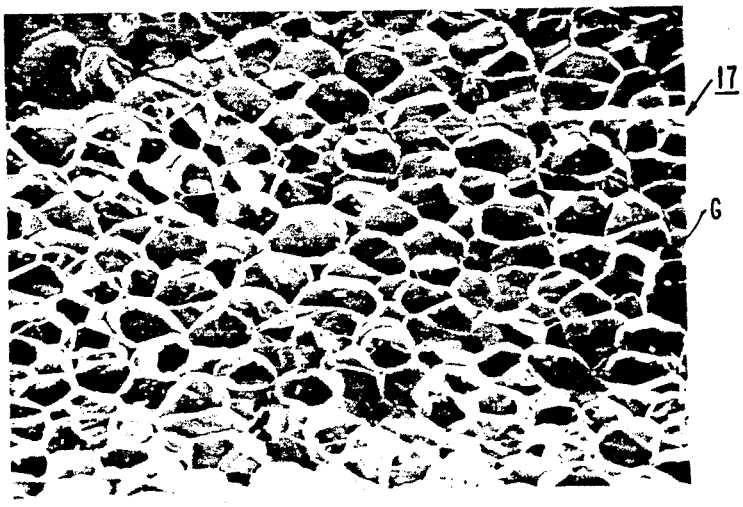
FIG. 3 is an SEM photograph of an alternate ta embodiment at a magnification of approximately 20 consisting of a polyethylene foam material havin high density of gas bubbles to promote retro-reflect

The retro-reflective surface pattern designed to achieve the desired diffuse reflection of impinging infrared radiation may be realized, as shown in the scanning electron microscope photograph of FIG. 3, by applying a composition 17 exhibiting low absorption of infrared radiation and including small gas bubbles or voids G. Scattering of the infrared radiation results from reflections at the surface of the bubbles G and ray bending due to the variation of the indices of refraction of the bubbles G and the composition 17.

The material composition 17 of FIG. 3 is preferably a polyethylene foam material having a high density of extremely small bubbles or voids G. The sectioned illustration of the foam binder B was photographed with a high magnification ($\sim 200\times$) so that the walls of individual bubbles B are easily discernible. There are several reasons why polyethylene foam is especially effective and efficient in accomplishing diffuse retroreflection of IR radiation. While several plastic materials are suitable, polyethylene is one of the most efficient for transmission of IR radiation. In addition, it can be produced with the relatively small gas bubbles required to achieve the diffuse scattering and reflection of the impinging primary IR radiation. Scattering of IR radiation results from a combination of reflection from all bubble surfaces and refraction due to the differences in indices of refraction between the foam material and the bubbles.

The efficiency of retro-reflection may be enhanced by the application of a layer of reflective metal such as aluminum on the back side of the polyethylene foam as discussed above with reference to FIG. 2B. Any radiation which reaches the back side of the foam will then be efficiently reflected back through the maze of bubbles to further accomplish the random diffuse reflection. The layer of reflective metal may typically be a thin foil onto which the foam is affixed, or a thin metal layer which is vapor deposited directly onto the foam. In either case, the foam/metal composite is suitable for accommodating an adhesive backing for each attachment to an object.

Figure 4:
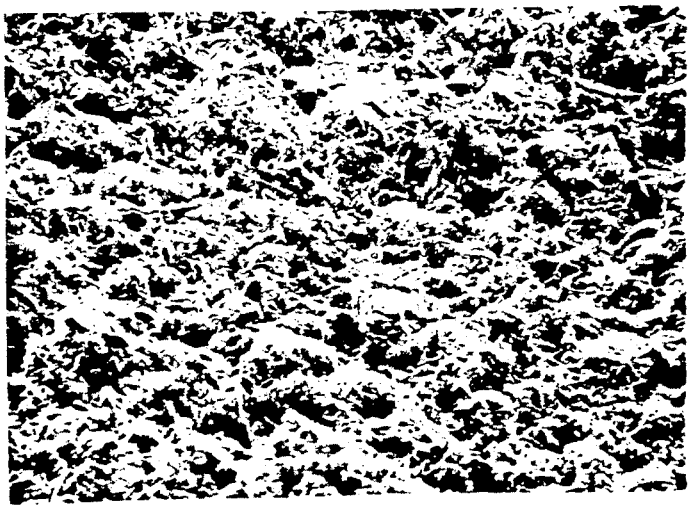
FIG. 4 is an SEM photograph of an alternate ta embodiment at a magnification of approximately 5 consisting of a shot-peened metal surface.

Surface treatment of a thin metal sheet may be employed to produce the target 10. A thin, pliable sheet material exhibiting high reflectivity of infrared radiation is surface treated to produce a pattern to achieve the reflective response described above. The surface texture may be achieved by numerous techniques including shot peening, as shown in the SEM photograph of FIG. 4, sand blasting, liquid honing, chemicial etching, electrochemical etching, and metallic vapor deposition and a randomly contoured surface.

Figure 5B:
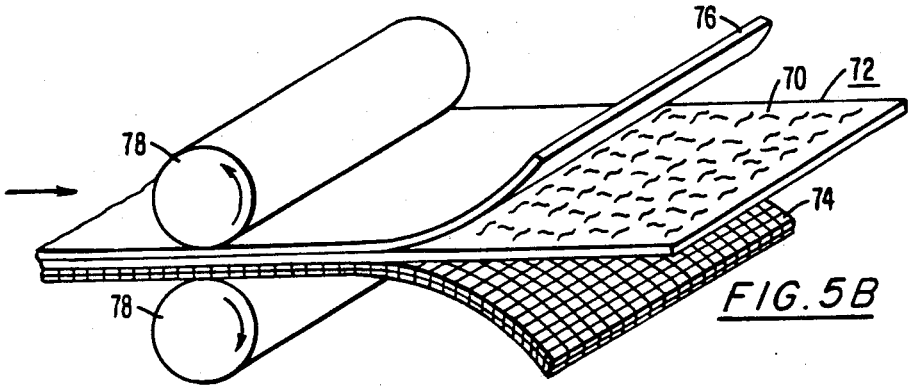
FIG. 5B is an SEM photograph of a target emb ment at a magnification of approximately 30×, con ing of a thin metal sheet with a reflective patter contours resulting from the target forming techniqu FIG. 5A.
Figure 5A:
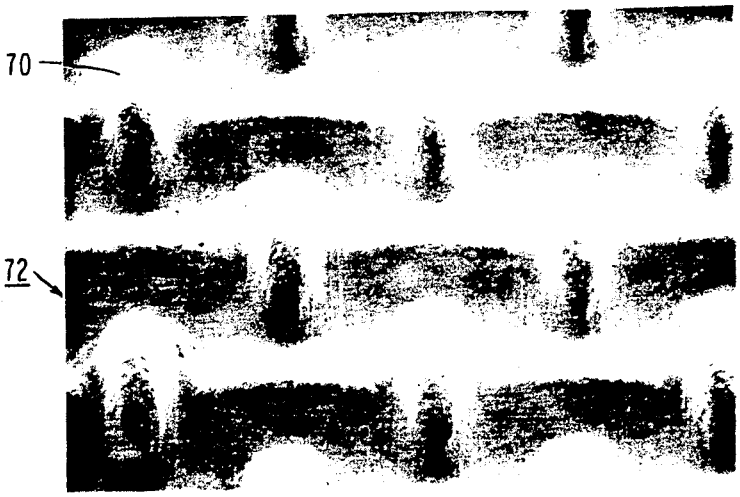
FIG. 5A depicts a technique for producing a ta embodiment by impressing a pattern of reflective tours on a thin metal sheet.

A preferred mechanical approach is illustrated in FIG. 5A. A reflective pattern 70 of contours is formed on the surface of a metallic sheet material 72, e.g., aluminum, by pressing the sheet material 72 relative to a pattern form 73 as shown in FIG. 5B. The pattern form 73 includes a reference pattern member 74 and a resilient (e.g. rubber) member 76. The pressure contact between the sheet material 72 and the form 73 may typically be applied by roller members 78 traversing the combination of the sheet material 72 and the pattern form 73. Experimental efforts have verified that conventional screen material of appropriate mesh size and wire size effectively functions as a reference pattern member 74.

In a preferred embodiment of the target concept of FIG. 5B an aluminum foil sheet material (e.g. 0.002–0.010 inches thick) is placed between a sheet of rubber or platen, (0.060 inch thick) and a sheet of screen material of the desired mesh and wire size serving as a die. The three component combination is then passed between the rollers of a rolling mill causing the aluminum foil to deep draw (stretch) into the openings in the screen and partially conform to the contour of the screen material. Obviously, the die and platen could be integral parts of the rolls of the rolling mill, and a wide variety of suitable die designs are possible. A die with round holes would provide a greater three dimensional symmetry of retro-reflection. Having defined the die, the hardness and thickness of the metallic sheet, and the surface condition of the contacting surfaces, large quantities of consistent quality contoured target material can be probuced.

FIG. 5B is a scanning electron microscope (SEM) photograph of a small area of a contoured pattern on a thin metal sheet target material formed in accordance with the technique of FIG. 5A. At the magnification scale of approximately 30× the design of the pattern repeats approximately every 0.8 mm in either direction. This pattern is sufficiently small that the individual pattern contours are not discernible with a typical IR viewing scope. Rather a total reflection pattern is detected.

Reflection from the three dimensional contoured surface of the target surface pattern 70 produced in accordance with the technique of FIG. 5A provides significant flexibility for novel target design. The surface of the target may be such as to produce diffuse reflection, (angles of less than 180°). For some night target practice ranges a small viewing angle may be preferred. The target surface pattern, as dictated by the reference pattern member, may be such that the targets are visible for a range of horizontal and/or vertical angles.

Of the various techniques for achieving the desired distribution of projected radiation from practice targets, the contoured thin metal sheet embodiment permits the greatest design flexibility and reflection efficiency. The contour of the metallic sheet can be made to retroreflect in a fan shaped pattern or in a hemispherical pattern. Also, the angular distribution of radiant energy within these patterns can be made to simulate thermal radiation (essentially a cosine distribution), or if desired, the radiation can be confined to a smaller projected angle to be consistent with the geometry of the target practice range. The primary advantage of tailoring the radiation for a specific application is to eliminate the unused (extraneous) retro-reflection and thereby increase the reflection efficiency by decreasing the required intensity of impinging primary IR radiation.

Figure 6:
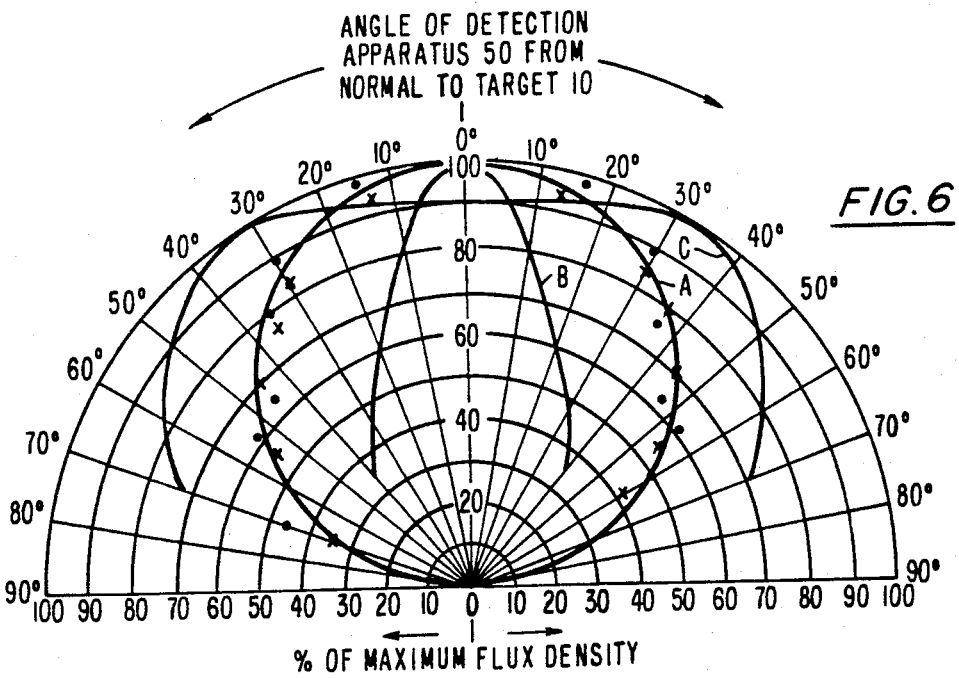
FIG. 6 is a graphical comparision of the reflec from the novel practice targets with the flux de obtained from an actual thermal target.

Recognizing that a conventional flat thermal target radiates in a diffuse manner corresponding to a cosine distribution, there is illustrated graphically in FIG. 6 a comparison between the retro-reflection obtained with the non-thermal target devices described above and the flux density obtained from a conventional thermal t get. The angular distribution of reflection data for t different target reflectors are shown in FIG. 6 by t +and 0 data points. The curve A drawn through th experimental data points essentially coincides with cosine distribution curve for thermal radiation. A shown in FIG. 6 are curves B and C corresponding experimentally measured angular distribution of t other distinct targets. Curve B corresponds to a tar surface having relatively shallow contours while cu C represents a target surface having relatively de contours. Curves B and C have been included to e phasize the design flexibility which can be achiev with the novel target reflector design concept descrit above. These data were collected with the primary illumination impinging essentially normal to the tar surface.

I claim:

1. An infrared radiation responsive target syste comprising, a non-thermal target structure for scattering impi ing infrared radiation to produce retro-reflec infrared radiation in a diffuse distribution simul ing the radiation distribution of a thermal targe a source of infrared radiation energy for direct infrared radiation energy onto said non-therr target structure, and infrared radiation detection means responsive to retro-reflected infrared radiation from said n thermal target structure.

2. A system as claimed in claim 1 wherein said tar structure is comprised of a reflective pattern of eleme wherein the spacing of the elements is less than resolution of said infrared detection means.

3. A system as claimed in claim 1 wherein said diff distribution corresponds essentially to a cosine radiat distribution.

4. Apparatus as claimed in claim 1 wherein said tar structure includes a coating composition having r domly oriented particles which exhibit a relatively l absorption of infrared energy and a relatively h index of refraction randomly dispersed in a bin which exhibits relatively low absorption of infra radiation, said randomly oriented particles causing r dom reflection, or scattering, thereby simulating ra tion of a thermal target.

5. Apparatus as claimed in claim 4 further includin metallic support member of a material which is hig reflective of infrared radiation, said coating comp tion being disposed on said metallic support memt said coating being sufficiently thin to minimize infra radiation absorption and enhance the retro-reflect efficiency of the target structure.

6. Apparatus as claimed in claim 1 wherein said pa cles are selected from a group comprising silicon, g manium, zinc selenide and sodium chloride.

7. Apparatus as claimed in claim 1 wherein said tar structure comprises a foam material including bubl or voids, the foam material being highly transmissiv impinging infrared radiation, the surface of the bubl functioning to scatter and reflect impinging infra radiation.

8. Apparatus as claimed in claim 7 wherein said fc material being polyethylene.

9. Apparatus as claimed in claim 7 further includir metallic support member of a material which is hig reflective of infrared radiation, said foam material be affixed to said metallic support member.

10. A system as claimed in claim 1 wherein said target structure is a surface treated metallic material producing retro-reflected radiation in a cosine distribution simulating the radiation distribution of a thermal target.

11. An infrared radiation responsive target apparatus, comprising, a target structure for scattering impinging infrared radiation to produce retro-reflected infrared radiation exhibiting a diffuse, or semi-diffuse, distribution of radiant energy, said target structure including a coating composition having particles which exhibit a relatively low absorption of infrared radiation and relatively high index of refraction randomly dispersed in a binder which exhibits relatively low absorption of infrared radiation, said binder being selected from a group comprising polyethylene, silicon and poly(iso-butylene).

12. An infrared radiation responsive target apparatus, comprising:

a non-thermal target structure for scattering impinging infrared radiation to produce retro-reflected infrared radiation exhibiting a diffuse distribution of radiant energy simulating the radiation distribution of a thermal target, said target structure being a surface treated metallic material which retro-reflects impinging infrared radiation, and an infrared radiation detector means responsive to said diffuse reflection, said metallic material being a metal film having a surface pattern of contours to effect the retro-reflection of impinging infrared radiation, the individual contours not being discernible by said infrared radiation detector means.

* * * * *